US010860043B2

(12) United States Patent
Hung et al.

(10) Patent No.: US 10,860,043 B2
(45) Date of Patent: Dec. 8, 2020

(54) FAST TRANSIENT RESPONSE VOLTAGE REGULATOR WITH PRE-BOOSTING

(71) Applicant: MACRONIX INTERNATIONAL CO., LTD., Hsinchu (TW)

(72) Inventors: Chun-Hsiung Hung, Hsinchu (TW); Shang-Chi Yang, Changhua (TW)

(73) Assignee: MACRONIX INTERNATIONAL CO., LTD., Hsinchu (TW)

( * ) Notice: Subject to any disclaimer, the term of this patent is extended or adjusted under 35 U.S.C. 154(b) by 13 days.

(21) Appl. No.: 15/658,286

(22) Filed: Jul. 24, 2017

(65) Prior Publication Data

US 2019/0025861 A1 Jan. 24, 2019

(51) Int. Cl.
*G05F 1/46* (2006.01)
*G05F 1/565* (2006.01)

(52) U.S. Cl.
CPC ..... *G05F 1/465* (2013.01); *G05F 1/565* (2013.01)

(58) Field of Classification Search
None
See application file for complete search history.

(56) References Cited

U.S. PATENT DOCUMENTS 5,446,644 A 8/1995 Zhou
5,512,831 A 4/1996 Cisar et al.
5,831,566 A 11/1998 Ginetti
5,852,360 A 12/1998 Levinson
5,894,281 A 4/1999 Toda
7,282,902 B2 10/2007 Chang et al.
7,283,082 B1 10/2007 Kuyel
7,397,226 B1 7/2008 Mannama et al.
7,551,112 B2 6/2009 Choi et al.
7,573,411 B2 8/2009 Shin et al.
(Continued)

FOREIGN PATENT DOCUMENTS

CN 101345288 A 1/2009
CN 101957625 A 1/2011
(Continued)

OTHER PUBLICATIONS

"Low-dropout regulator," https://en.wikipedia.org/wiki/Low-dropout_regulator?oldid=767916335; Feb. 28, 2017, 5 pages.
(Continued)

*Primary Examiner* — Kyle J Moody
(74) *Attorney, Agent, or Firm* — Haynes Beffel & Wolfeld LLP

(57) ABSTRACT

A circuit and a method for supplying a regulated voltage to a target circuit characterized by fast changes in current loading are described. A voltage regulator supplies the regulated voltage to an output node. The voltage regulator has a transistor having a gate, a first terminal connected to a power supply terminal, and a second terminal connected to the output node of the voltage regulator. A voltage transition generator is capacitively coupled to the gate of the transistor to increase or decrease its driving power upon occurrence of an event in the target circuit indicating a change in current loading. The change in current loading can have an expected magnitude, and the voltage transition can have a magnitude that is a function of an expected magnitude of the increase or decrease in current loading.

16 Claims, 4 Drawing Sheets

(56) References Cited

U.S. PATENT DOCUMENTS

| | | | | |
|---|---|---|---|---|
| 7,928,871 | B2 | 4/2011 | Aruga et al. | |
| 8,054,302 | B2 | 11/2011 | Kim et al. | |
| 8,089,261 | B2 | 1/2012 | Lipka | |
| 8,618,971 | B1 | 12/2013 | Li | |
| 8,710,813 | B2 | 4/2014 | Yang et al. | |
| 9,053,814 | B2 | 6/2015 | Lee | |
| 9,069,370 | B2 | 6/2015 | Soenen et al. | |
| 9,104,223 | B2 * | 8/2015 | Zhong | G05F 1/59 |
| 9,170,592 | B2 | 10/2015 | Seymour et al. | |
| 9,239,584 | B2 | 1/2016 | Lerner et al. | |
| 9,261,892 | B2 | 2/2016 | Wang et al. | |
| 9,310,816 | B2 | 4/2016 | Chang et al. | |
| 9,471,078 | B1 * | 10/2016 | Guan | G05F 1/56 |
| 9,553,548 | B2 | 1/2017 | Park et al. | |
| 9,825,644 | B2 | 11/2017 | Kim | |
| 9,857,815 | B2 | 1/2018 | Caracciolo | |
| 10,191,503 | B2 * | 1/2019 | Ogura | G05F 1/468 |
| 2006/0012932 | A1 | 1/2006 | Kitagawa | |
| 2006/0176032 | A1 | 8/2006 | Malherbe et al. | |
| 2006/0224337 | A1 | 10/2006 | Hazucha et al. | |
| 2007/0171106 | A1 | 7/2007 | Bingel et al. | |
| 2008/0180082 | A1 | 7/2008 | Fan | |
| 2009/0128107 | A1 * | 5/2009 | Wang | G05F 1/575 323/280 |
| 2010/0026251 | A1 * | 2/2010 | Lam | H02M 3/156 323/273 |
| 2010/0079210 | A1 | 4/2010 | Yamauchi et al. | |
| 2010/0156364 | A1 * | 6/2010 | Cho | G05F 1/573 323/280 |
| 2010/0237839 | A1 | 9/2010 | Gurcan | |
| 2011/0121802 | A1 | 5/2011 | Zhu | |
| 2012/0306506 | A1 | 12/2012 | Kiuchi | |
| 2013/0119954 | A1 * | 5/2013 | Lo | G05F 1/10 323/280 |
| 2013/0234687 | A1 * | 9/2013 | Fujimura | G05F 1/575 323/282 |
| 2014/0084881 | A1 | 3/2014 | Shih et al. | |
| 2014/0340067 | A1 | 11/2014 | Zhong et al. | |
| 2014/0368176 | A1 * | 12/2014 | Mandal | G05F 1/575 323/280 |
| 2015/0035505 | A1 | 2/2015 | Peluso | |
| 2016/0173066 | A1 | 6/2016 | Yang et al. | |
| 2016/0231761 | A1 | 8/2016 | Jain et al. | |
| 2017/0077808 | A1 | 3/2017 | Iwai et al. | |
| 2017/0285675 | A1 * | 10/2017 | Gao | G05F 1/575 |
| 2019/0050008 | A1 * | 2/2019 | Nakashima | G05F 1/467 |
| 2019/0258282 | A1 * | 8/2019 | Magod Ramakrishna | G05F 1/565 |

FOREIGN PATENT DOCUMENTS

| | | | |
|---|---|---|---|
| CN | 102541134 | A | 7/2012 |
| CN | 103427617 | A | 12/2013 |
| CN | 203733021 | U | 7/2014 |
| CN | 106647912 | A | 5/2017 |
| CN | 106886243 | A | 6/2017 |
| DE | 202012011893 | U1 | 1/2013 |
| EP | 899645 | A2 | 3/1999 |
| TW | 201418926 | A | 5/2014 |

OTHER PUBLICATIONS

"Operational Amplifier," https://en.wikipedia.org/wiki/Operational_amplifier, downloaded on May 1, 2017, 22 pages.

Sanchez-Sinencio, "Low Drop-Out (LDO) Linear Regulators: Design Considerations and Trends for High Power-Supply Rejection (PSR)," IEEE Santa Clara Valley Solid Circuits Society, Feb. 11, 2010, 47 pages.

Zumbahlen, The Linear Circuit Design Handbook, Chapter 1, Analog Devices, Inc., Mar. 13, 2008, 104 pages.

Office Action in U.S. Appl. No. 15/641,167 dated Jan. 17, 2018, 9 pages.

EP Extended Search Report from EP 17183508.5 dated Apr. 20, 2018, 10 pages.

Rohm Semiconductor: "White Paper CMOS LDO 1-15 Regulators for portable devices," Jan. 1, 1999, 10 pages.

U.S. Notice of Allowance in U.S. Appl. No. 15/658,745 dated Jul. 16, 2018, 7 pages.

U.S. Office Action in U.S. Appl. No. 15/641,167 dated Jun. 28, 2018, 12 pages.

U.S. Office Action in U.S. Appl. No. 15/641,167 dated Jan. 28, 2019, 9 pages.

U.S. Office Action in U.S. Appl. No. 15/673,644 dated Apr. 15, 2019, 10 pages.

CN Office Action in 201810016799.1 dated May 28, 2020, 12 pages.

* cited by examiner

FAST TRANSIENT RESPONSE VOLTAGE REGULATOR WITH PRE-BOOSTING

BACKGROUND

Technical Field

The present invention relates to voltage regulators, including voltage regulators used in integrated circuits having rapidly changing loads.

Description of Related Art

Voltage regulators are utilized in integrated circuit design to provide a supply voltage to internal circuitry that can be more stable than an external power supply.

In integrated circuits having rapidly changing loads, the transient response of the voltage regulators can be a limiting property. If the current load of the target circuit changes rapidly, such as on the order of the transient response of the voltage regulator, then the regulated voltage provided can spike, overshoot, undershoot or fluctuate during the transition. These spikes or fluctuations can limit the effectiveness of the target circuit.

For example, a voltage regulator, in a class of regulators known as low dropout LDO voltage regulators, comprises a power MOSFET that is connected between an external power supply and the output node of the regulator. The gate of the power MOSFET is driven by an amplifier with a feedback loop to maintain constant voltage on the output node. The power MOSFET can be very large, and have a large gate capacitance. This large gate capacitance increases the time constant of the feedback loop, and makes the transient response of a typical LDO relatively slow compared to nanosecond scale switching in electronic circuits. As a result, a target circuit can be exposed to spikes or fluctuations in the regulated voltage during events that cause a change in current loading by the target circuit.

It is desirable to provide a voltage regulator suitable for use in integrated circuits, with a stable output voltage during fast transitions in current loading in a target circuit.

SUMMARY

A circuit and a method are described for supplying a regulated voltage to a target circuit characterized by fast changes in current loading. Circuits described herein include a voltage regulator to supply the regulated voltage to an output node. The voltage regulator has a transistor having a gate, a first terminal connected to a power supply terminal, and a second terminal connected to the output node of the voltage regulator. A voltage transition generator is capacitively coupled to the gate of the transistor. Logic circuitry is coupled to the voltage transition generator to induce a voltage transition at the gate upon occurrence of an event in the target circuit indicating a change in current loading, and thereby increase or decrease the gate-to-source voltage of the transistor, to change its driving power in a way that reduces fluctuations in the output voltage. The change in current loading can have an expected magnitude, and the voltage transition can have a magnitude that is a function of an expected magnitude of the increase or decrease in current loading.

The voltage transition generator can produce a stepped waveform, or other waveform shapes having fast transitions, synchronized with events indicating changes in current loading in the target circuit. The logic can be configured to cause a positive transition that increases the gate-to-source voltage magnitude in response to an event indicating an increase in current loading and a negative transition that decreases the gate-to-source voltage magnitude in response to an event indicating a decrease in current loading.

Thus, for example, an integrated circuit can include circuits such as state machines or processors that perform logic operations having predictable mode changes that cause rapid increases and decreases in current loading on the voltage regulator. The boosting circuit as described herein can be enabled to apply gate voltage adjustments upon transitions in current loading so that fluctuations in the regulated supply voltage upon occurrence of an event in the mode change are reduced or eliminated A method for supplying a regulated voltage to a target circuit characterized by fast changes in current loading is also described. The method in one aspect comprises supplying the regulated voltage on an output node coupled to the target circuit, using a transistor having a gate, a first terminal connected to a power supply terminal, and a second terminal connected to the output node. By causing a voltage transition at the gate upon occurrence of an event in the target circuit, expected to cause a change in current loading, fluctuations in the regulated voltage are reduced or eliminated. The voltage transition is executed in some embodiments in response to the logic signal indicating occurrence of an event expected to cause the change in current loading. Causing the voltage transition can include generating a waveform having a voltage transition synchronized with events causing changes in current loading in the target circuit.

Other aspects and advantages of the present technology can be seen on review of the drawings, the detailed description and the claims, which follow.

DETAILED DESCRIPTION

A detailed description of embodiments of the present invention is provided with reference to the FIGS. 1-4.

Figure 1:
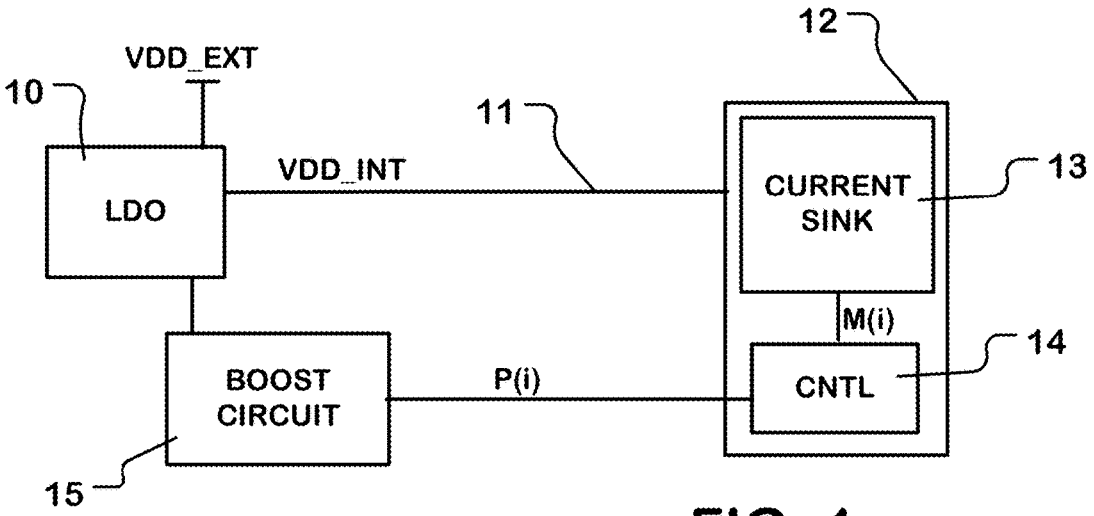
FIG. 1 is a simplified block diagram of a device including a fast transient response voltage regulator with predictive boosting as described herein.

FIG. 1 illustrates a voltage regulator 10 connected to a target circuit 12. The voltage regulator 10, such as an LDO voltage regulator, is connected to a predictive boost circuit 15. The voltage regulator 10 supplies a regulated voltage VDD_INT generated by the voltage regulator 10 as an internal supply voltage on an output node 11 to the target circuit 12. The target circuit 12 includes a current sink 13 and control logic 14. The control logic 14 can supply mode change signals M(i), where i is an index for a set of signals, to the current sink 13 which causes a fast change in current loading by the target circuit 12. Also, the control logic 14 can supply one or more signals P(j), where j is an index for a set of signals, to predictive boost circuits 15. The signals P(j) indicate events such as the events indicated by signals M(i), expected to cause changes in current loading in the current sink 13. Although, as illustrated, the signals P(j) include at least one signal provided by the control logic 14 in the target circuit. In other configurations, logic outside the target circuit can produce the signals P(j). Also, the signals P(j) can be the same as the signals M(i) in some embodiments.

In one example, the target circuit 12 comprises an integrated circuit memory. The target circuit 12 can comprise a variety of circuits other than integrated circuit memory.

In the integrated circuit memory example, the current sink 13 includes a memory array and peripheral circuits used during operation of the memory array. The control logic 14 can include a state machine or other logic circuitry used to change the operating modes of the memory. For example, the memory can include a page read mode with error correction. A transition in mode change signal M(1) can be an event indicating a beginning of a page read operation. A transition in signal M(2) can be an event indicating the timing of a predicted transition in which there is a fast increase in current loading during the read operation. For example, during a page read operation with error correction, it can be predicted that there will be a rapid increase in current loading when error correction operations are initiated as the data is retrieved from the memory array. By way of example, the increase in current loading can occur on a nanosecond scale as the error correction circuits are engaged to process a page of data retrieved from the memory. A corresponding decrease in current loading can occur when the error correction operation completes. A signal M(3) can indicate the timing of a predicted transition in which there is a fast decrease in current loading during the read operation. The control logic 14 can provide signals P(1), P(2) and P(3) to the boost circuit 15 synchronized with corresponding signals M(1), M(2) and M(3), respectively. The control logic 14 can provide signals P(1), P(2) and P(3) in advance of the actual expected change in current loading, so that the voltage transition can be timed effectively to coincide with the expected current loading change.

Figure 2:
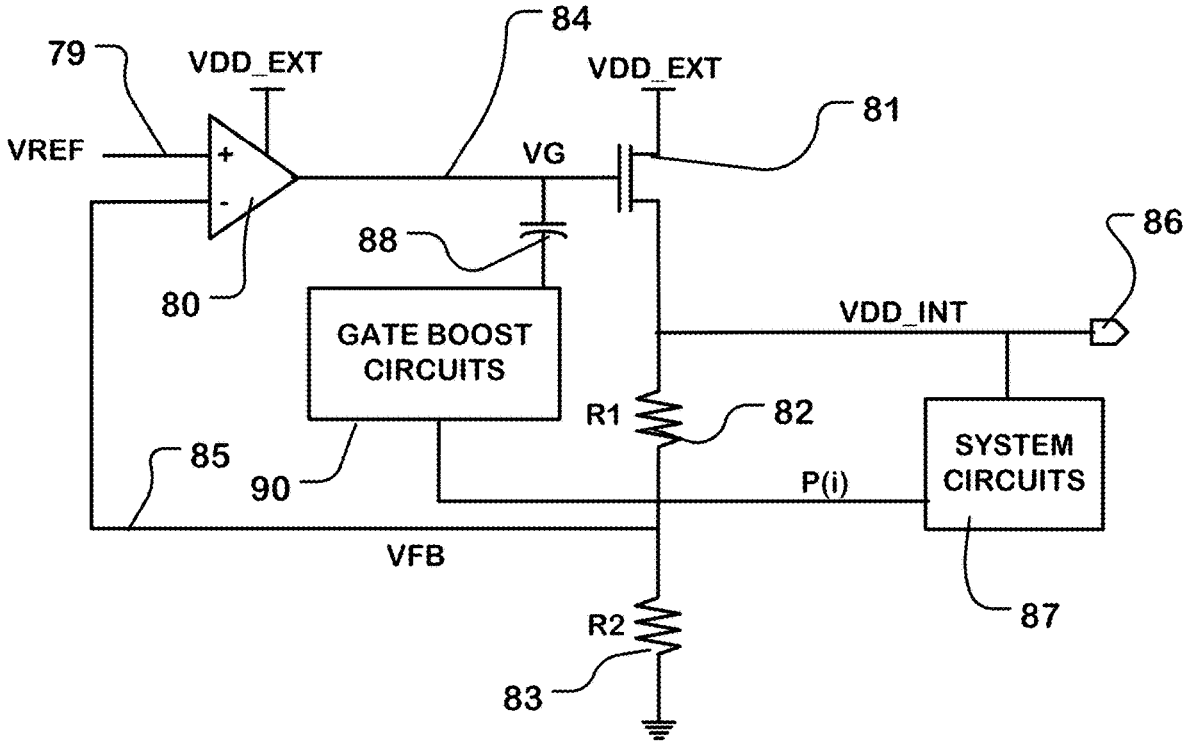
FIG. 2 is a circuit diagram of a device including a fast transient response LDO voltage regulator and gate boost circuits as described herein.

FIG. 2 is a circuit diagram of an embodiment of a voltage regulator with fast transient response according to the technology described herein. The circuit in FIG. 3 includes an LDO voltage regulator that comprises an operational amplifier 80 coupled to an external power supply VDD_EXT, a transistor 81, which is an n-channel power MOSFET in this example, having a drain coupled to the external power supply VDD_EXT and having a source coupled to the output node 86. The operational amplifier 80 supplies a gate voltage VG on line 84 to the gate of transistor 81. A feedback circuit is coupled between the output node and the "−" input of the operational amplifier. A voltage reference supplies VREF on line 79 to the "+" input of the operational amplifier. The voltage reference can be a bandgap reference.

The feedback circuit in this example includes resistors 82 and 83 in series between the output node 86 and ground, and connector 85 connecting a node between resistors 82 and 83, at which a feedback voltage VFB is generated, to the "−" input. The resistors 82, 83 have values R1 and R2 which can be set to determine the level of the internal supply voltage VDD_INT generated on the output node 86.

The transistor 81 has a gate capacitance. The gate capacitance CC can be large in some embodiments, resulting in longer time constants for the feedback loop, and slower transient responses at the output node. A capacitor 88 is connected to the gate and to a node in the boost circuit 15 at which voltage transition signals are provided.

The output node 86 supplies the power supply voltage VDD_INT, and is connected to a target circuit, which can include system circuits 87 for an integrated circuit which are powered by VDD_INT. A gate boost circuit 90 is connected to the gate node (line 84) by capacitive coupling via discrete capacitor 88 to the node.

The system circuits 87 in this example generate control signals P(i) which are used to control timing of the signals produced by the boost circuit 90. The boost circuit can comprise a switching circuit having switches which boost voltage to a terminal of the capacitor 88 with a timing in response to the signals P(i). The boost voltage can have a magnitude that is a function of the expected change in current loading in the target circuit. The boost voltage can have a variable magnitude, or a magnitude selected from one of a plurality of fixed voltages, according to various implementations.

Figure 2A:
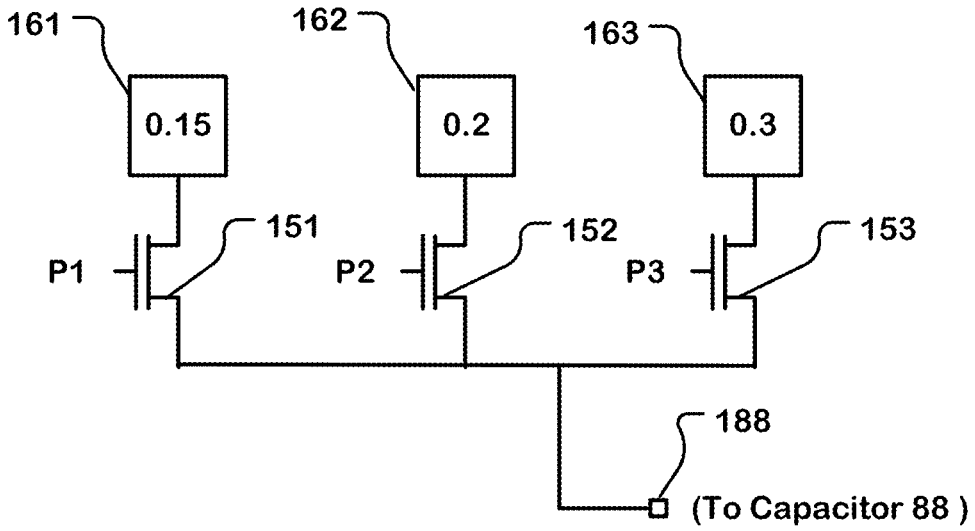
FIG. 2A is a simplified circuit diagram of a voltage switching circuit suitable for use in the gate boost circuits in an embodiment like that of FIG. 2.

FIG. 2A shows one example voltage switching circuit, suitable for use with gate boost circuit 90. The switching circuit includes switch transistors 151, 152, 153, which are connected at one terminal to corresponding voltage sources 161, 162, 163 having different voltage levels. The different voltage levels provided by voltage sources 161, 162, 163 can be set as appropriate for a given implementation, with examples shown in the figure set at 0.15 volts, 0.2 volts and 0.3 volts respectively. The transistors 151, 152, 153 are connected in common at another terminal to a node 188, which can be connected to one plate of the capacitor 88 of FIG. 2. The signals P(i) from system circuits 87 are applied to the gates of transistors 151, 152, 153. In this example, P1 is connected to the gate of transistor 151. P2 is connected to the gate of transistor 152. P3 is connected to the gate of transistor 153.

The embodiment of FIG. 2 uses an LDO with an n-channel power transistor 81. In alternative embodiments, an LDO with a p-channel power transistor can be used.

Figure 3:
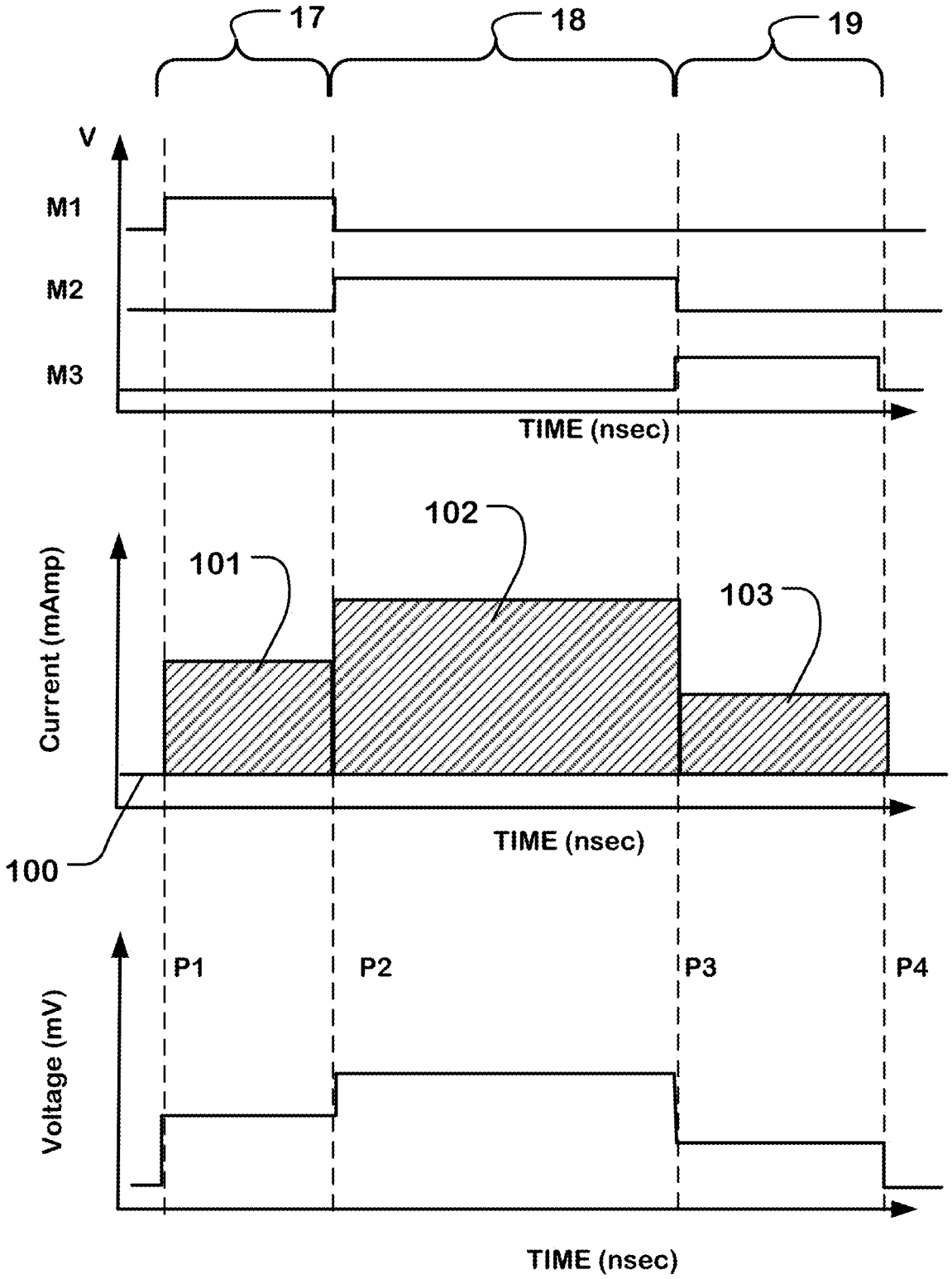
FIG. 3 is a timing diagram referred to for the purposes of describing the method of operating a device like that of FIG. 1 or 2.

FIG. 3 is a timing diagram referred to for the purposes of describing operation of the circuit of FIGS. 1 and 2.

In general, the circuit shown in FIG. 2 is an example that comprises an LDO voltage regulator supplying a regulated voltage on an output node. A gate boosting circuit is connected to the gate of a transistor driving the output node of the LDO voltage regulator. Logic is applied to cause the gate boosting circuit to apply a first voltage boost to the gate upon occurrence of, or synchronized with, a first event that increases current loading in the target circuit. Also, the logic causes the gate boosting circuit to apply a second voltage boost to the gate upon the occurrence of, or synchronized with, a second event that decreases current loading in the target circuit.

FIG. 3 is a timing diagram referred to for the purpose of describing the operation of the circuits of FIG. 1 and FIG. 2. It includes a timing diagram (upper graph) for the logic signals M(1), M(2) and M(3) generated in a control logic which indicate mode changes for transitions between modes in the time intervals 17, 18 and 19 during which transitions in current loading in the target circuit 12 are expected. FIG. 3 also includes a timing diagram (middle graph) for current loading on the output node of the voltage regulator, in which a baseline current 100 is drawn by the voltage regulator, the current loading increases during the interval 101 upon assertion of the logic signal M(1), increases again during interval 102 upon assertion of the logic signal M(2), and decreases during interval 103 upon assertion of the logic signal M(3).

FIG. 3 also includes the timing diagram (lower graph) for the boost voltage generated by the boost circuits. In this example, a signal P1 corresponds with the first transition of the signal M1. This causes a positive transition in the voltage output by the boosting circuit, in order to boost the gate-to-source voltage of the transistor in the voltage regulator by a positive amount which corresponds with the expected increase in current loading upon transition to the interval 101. A signal P2 corresponds with the first transition of the signal M2. This causes a positive transition in the voltage output by the boosting circuit, in order to boost the gate-to-source voltage of the transistor in the voltage regulator by a positive amount which corresponds with the expected increase in current loading upon transition to the interval 102. A signal P3 corresponds with the first transition of the signal M3. This causes a negative transition in the voltage output by the boosting circuit, in order to boost the gate-to-source voltage by a negative amount which corresponds to the expected decrease in current loading upon transition to the interval 103. The signal P4 corresponds with the second transition of the signal M3 in this example, causing a negative transition in the voltage output by the boosting circuit, in order to boost the gate-to-source voltage by a negative amount which corresponds to the expected decrease in current loading upon transition back to the baseline 100.

Of course, the actual current levels occurring during the various modes of the target circuit may vary over time, and the transition amounts may differ from one instance of the mode change to another. However, the expected transition in current loading can be predicted based on simulation of the circuit designs, or empirical data.

Preferably, the transitions in the boost voltage corresponding with signals P1-P4 precede the transitions in current loading indicated by the signals M1-M3. The timing of the transitions in the boost voltage should correspond with the changes in current loading within a time interval that is short relative to the frequency response of the amplifier and feedback loop of the voltage regulator.

In the example illustrated in FIG. 3, the boost voltage is a stepped waveform, with steps corresponding with expected changes in current loading.

Figure 4:
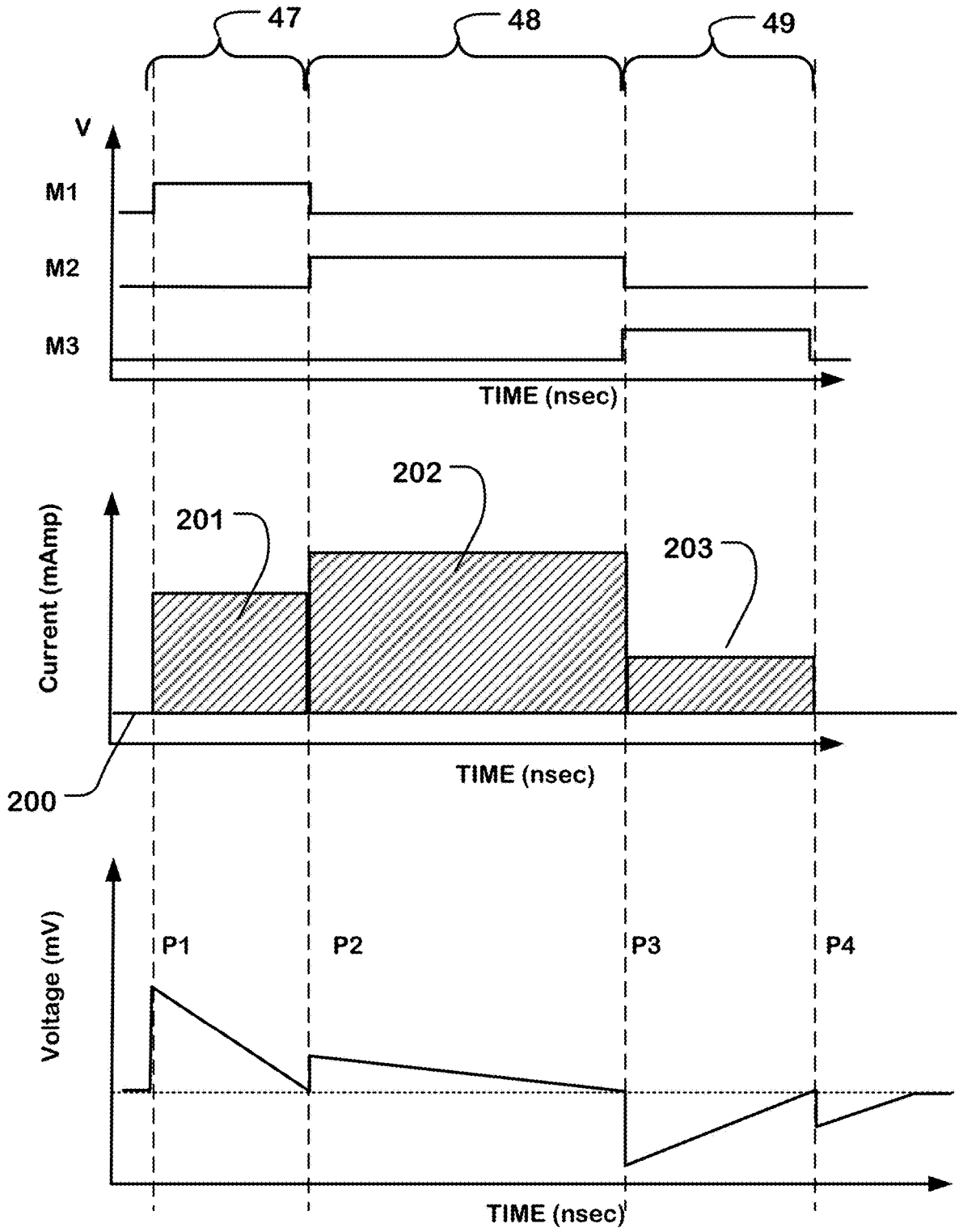
FIG. 4 is an alternative timing diagram referred to for the purposes of describing the method of operating a device like that of FIG. 1 or 2.

FIG. 4 illustrates a timing diagram referred to for the purpose of describing the operation of the circuits of FIG. 1 and FIG. 2 using an alternative boosting circuit. It includes a timing diagram for the logic signals M(1), M(2) and M(3) generated in a control logic which indicate mode changes for transitions between modes in the time intervals 47, 48 and 49 during which transitions in current loading in the target circuit 12 are expected. FIG. 4 also includes a timing diagram for current loading on the output node of the voltage regulator, in which a baseline current 200 is drawn by the voltage regulator, the current loading increases during the interval 201 upon assertion of the logic signal M(1), increases again during interval 202 upon assertion of the logic signal M(2), and decreases during interval 203 upon assertion of the logic signal M(3). FIG. 4 also includes the timing diagram for the boost voltage generated by the boost circuits. In this example, a signal P1 corresponds with the first transition of the signal M1. This causes a positive transition in the voltage output by the boosting circuit, in order to boost the gate-to-source voltage of the transistor in the voltage regulator by a positive amount which corresponds with the expected increase in current loading upon transition to the interval 201. The voltage output by the boost circuit ramps from its peak during the transition back to a baseline before the next transition. A signal P2 corresponds with the first transition of the signal M2. This causes a positive transition in the voltage output by the boosting circuit, in order to boost the gate-to-source voltage of the transistor in the voltage regulator by a positive amount which corresponds with the expected increase in current loading upon transition to the interval 202. Again, the voltage output by the boosting circuit ramps back to the baseline amount during the interval 202 before the next transition. A signal P3 corresponds with the first transition of the signal M3. This causes a negative transition in the voltage output by the boosting circuit, in order to boost the gate-to-source voltage by a negative amount which corresponds to the expected decrease in current loading upon transition to the interval 203. The voltage then ramps back up to the baseline for the next transition in current loading. The signal P4 corresponds with the second transition of the signal M3 in this example, causing a negative transition in the voltage output by the boosting circuit, in order to boost the gate-to-source voltage by a negative amount which corresponds to the expected decrease in current loading upon transition back to the baseline 200.

Allowing the voltage applied by the boost circuit to return to the baseline between transitions can reduce the load on the feedback loop in the voltage regulator caused by the boost circuit, and can allow the boost circuit to operate with a narrower range of voltage magnitudes.

Of course, the actual current levels occurring during the various modes of the target circuit may vary over time, and the transition amounts may differ from one instance of the mode change to another. However, the expected transition can be predicted based on simulation of the circuit designs, or empirical data.

As mentioned with respect to FIG. 3 the transitions in the boost voltage corresponding with signals P1-P4 are synchronized with the transitions in current loading indicated by the signals M1-M3. The timing of the transitions in the boost voltage should correspond with the changes in current loading within a time interval that is short relative to the frequency response of the amplifier and feedback loop of the voltage regulator.

For the purposes of this description, the voltage boosting is applied "upon occurrence of an event" when it is applied on a timescale corresponding to the transient response of the voltage regulator, so that fluctuations in the regulated voltage as a result of the changes in loading current in the target circuits are reduced or eliminated. For the purposes of this description, an event is synchronized with another event when its timing is dependent on said other event, such as when controlled by a transition of a common logic signal.

Technology is described for producing a regulated voltage for circuits having fast changes in current loading that includes predictive circuits to boost the response time of the regulator, so that the regulated voltage will have a more stable value.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

What is claimed is:

1. A circuit which supplies a regulated voltage to a target circuit characterized by fast changes in current loading, comprising:

a voltage regulator to supply the regulated voltage on an output node, the voltage regulator including a transistor having a gate, a first terminal connected to a power supply terminal, a second terminal connected to the output node, and a feedback amplifier that generates a gate voltage at the gate of the transistor that maintains current flow in the transistor to maintain the regulated voltage;

a capacitor having a first terminal coupled to the gate of the transistor, and a second terminal;

a voltage transition generator coupled to the second terminal of the capacitor; and logic to cause the voltage transition generator to induce a voltage transition in the gate voltage at the gate by applying a waveform on the second terminal of the capacitor upon occurrence of an event in the target circuit indicating a change in current loading to adjust current flow in the transistor as compensation for the change in current loading.

2. The circuit of claim 1, wherein the change in current loading in the target circuit has an expected magnitude and the voltage transition has a magnitude that is a function of the expected magnitude of the change in current loading.

3. The circuit of claim 1, wherein the waveform applied by the voltage transition generator comprises a stepped waveform, with transitions between steps in the waveform synchronized with events indicating changes in current loading in the target circuit.

4. The circuit of claim 1, wherein the waveform applied by the voltage transition generator comprises transitions in the waveform synchronized with events indicating changes in current loading in the target circuit.

5. The circuit of claim 1, wherein the logic is configured to cause a transition in the waveform that increases a gate-to-source voltage magnitude on the transistor in response to an event indicating an increase in current loading in the target circuit, and to cause a transition in the waveform that decreases a gate-to-source voltage magnitude in response to an event indicating a decrease in current loading in the target circuit.

6. The circuit of claim 1, wherein the voltage regulator comprises a low drop out (LDO) regulator.

7. The circuit of claim 1, wherein the feedback amplifier includes an amplifier having an output connected to the gate of the transistor, and a feedback circuit between the output node and an input of the amplifier.

8. A circuit which supplies a regulated voltage to a target circuit characterized by fast changes in current loading, comprising:

a low drop out (LDO) voltage regulator to supply the regulated voltage on an output node connected to the target circuit, the voltage regulator including a transistor having a gate, a first terminal connected to a power supply terminal, a second terminal connected to the output node, and a feedback amplifier that generates a gate voltage at the gate of the transistor that maintains current flow in the transistor to maintain the regulated voltage;

a voltage transition generator capacitively coupled by a capacitor to the gate of the transistor, the capacitor not connected to the output node; and logic to cause the voltage transition generator to induce a first voltage transition in the gate voltage at the gate by capacitive boosting across the capacitor upon occurrence of a first event in the target circuit indicating an increase in current loading and to induce a second voltage transition in the gate voltage at the gate upon occurrence of a second event indicating a decrease in current loading to adjust current flow in the transistor as compensation for the changes in current loading.

9. The circuit of claim 8, wherein the change in current loading in the target circuit has an expected magnitude, and the first voltage transition has a magnitude that is a function of the expected magnitude of the increase in current loading.

10. The circuit of claim 8, wherein the voltage transition generator produces a stepped waveform, with transitions between steps in the waveform synchronized with events indicating changes in current loading in the target circuit.

11. The circuit of claim 8, wherein the voltage transition generator produces a waveform with transitions in the waveform synchronized with events indicating changes in current loading in the target circuit.

12. A method for supplying a regulated voltage to a target circuit characterized by fast changes in current loading, comprising:

supplying the regulated voltage on an output node coupled to the target circuit using a transistor having a gate, a first terminal connected to a power supply terminal, and a second terminal connected to the output node, and a feedback amplifier that generates a gate voltage at the gate of the transistor that maintains current flow in the transistor to maintain the regulated voltage; and causing a voltage transition at the gate by applying a waveform to a capacitor coupled to the gate upon occurrence of an event in the target circuit expected to cause a change in current loading to adjust current flow in the transistor as compensation for the change in current loading, wherein the capacitor is not connected to the output node.

13. The method of claim 12, wherein causing the voltage transition is executed in response to a logic signal indicating occurrence of the event.

14. The method of claim 12, the waveform having voltage transitions synchronized with events causing changes in current loading in the target circuit.

15. The method of claim 12, wherein causing the voltage transition includes inducing a first voltage transition at the gate upon occurrence of a first event in the target circuit indicating an increase in current loading and to induce a second voltage transition at the gate upon occurrence of a second event indicating a decrease in current loading.

16. The method of claim 12, wherein said supplying the regulated voltage includes using a low drop out (LDO) regulator.

* * * * *